US010465927B2

(12) United States Patent
Chen et al.

(10) Patent No.: US 10,465,927 B2
(45) Date of Patent: Nov. 5, 2019

(54) CONSTANT WATER LEVEL HUMIDIFIER

(71) Applicant: ZHANGZHOU WANLIDA ELECTRICAL APPLIANCE CO., LTD., Zhangzhou, Fujian (CN)

(72) Inventors: Chengmin Chen, Fujian (CN); Zhong Huang, Fujian (CN); Shun'an Huang, Fujian (CN)

(73) Assignee: ZHANGZHOU WANLIDA ZHONGHUAN TECHNOLOGY INC., Zhangzhou (CN)

( * ) Notice: Subject to any disclaimer, the term of this patent is extended or adjusted under 35 U.S.C. 154(b) by 157 days.

(21) Appl. No.: 15/823,161

(22) Filed: Nov. 27, 2017

(65) Prior Publication Data

US 2018/0149379 A1 May 31, 2018

(30) Foreign Application Priority Data

Nov. 28, 2016 (CN) ..... 2016 2 1284127 U

(51) Int. Cl.

| | |
|---|---|
| ***F24F 3/14*** | (2006.01) |
| ***B01F 3/04*** | (2006.01) |
| ***F24F 6/12*** | (2006.01) |
| ***F24F 6/06*** | (2006.01) |
| *F24F 110/20* | (2018.01) |

(52) U.S. Cl.

CPC ..... *F24F 6/12* (2013.01); *B01F 3/04* (2013.01); *B01F 3/0407* (2013.01); *F24F 3/14* (2013.01); *F24F 6/06* (2013.01); *F24F 2110/20* (2018.01)

(58) Field of Classification Search

CPC ..... F24F 3/14; B01F 3/0407
USPC ..... 261/72.1, 38, 81
See application file for complete search history.

(56) References Cited

U.S. PATENT DOCUMENTS 9,360,227 B2 * 6/2016 Barker ..... F24F 6/00

* cited by examiner

*Primary Examiner* — Robert A Hopkins
(74) *Attorney, Agent, or Firm* — Rabin & Berdo, P.C.

(57) ABSTRACT

A constant water level humidifier has an outer tank with an outer outlet disposed at the bottom, the outer outlet is disposed with an oscillating plate, the upper portion of the outer tank is disposed with an outer air vent connected to the outer world; wherein the outer tank is further disposed with an inner tank, the upper portion of the inner tank is disposed with an inner air vent connected to the outer air vent, the bottom portion of the inner tank is disposed with an inner outlet connected to the outer outlet of the outer tank and an inner inlet connected to the chamber of the outer tank, the inner inlet is disposed with a water level control mechanism.

5 Claims, 1 Drawing Sheet

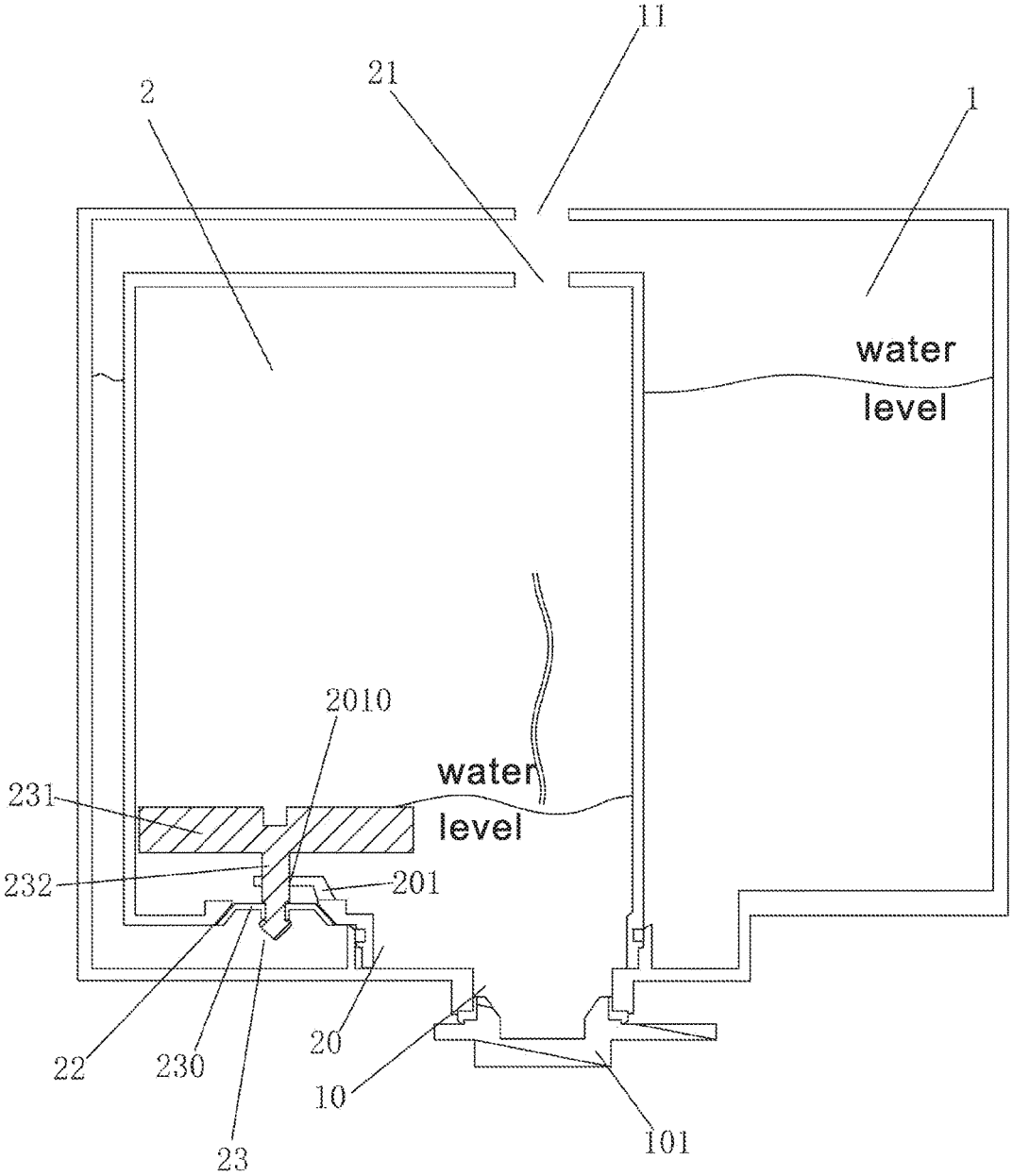
11
21
2
1
water
level
2010
water
level
231
232
201
22
230
20
10
23
101

CONSTANT WATER LEVEL HUMIDIFIER

FIELD OF THE INVENTION

The present invention relates to a constant water level humidifier.

BACKGROUND OF THE INVENTION

Ultrasonic humidifiers are widely used in the household, office and hospital to moisturize the air to obtain good humidity range. In existing known technology, the ultrasonic humidifier controls its water level by one of the following methods: 1. the water tank is closed, and the opening is faced down; when the water level exceeds the opening, the water tank doesn't discharge water due to the barometric pressure so as to control the water level; 2. a water pump is used to deliver water to the working groove of the oscillating plate, the working groove is disposed with a gap; when in a high water level, water flows back to the water groove from the gap so as to control the water level. However, either the closing water tank or the water pump costs high that the products are not competitive.

SUMMARY OF THE INVENTION

The present invention is provided with a constant water level humidifier to overcome the disadvantages of the existing known technology.

The technical proposal of the present invention is that:

A constant water level humidifier, comprising an outer tank with an outer outlet disposed at the bottom, the outer outlet is disposed with an oscillating plate, the upper portion of the outer tank is disposed with an outer air vent connected to the outer world; wherein the outer tank is further disposed with an inner tank, the upper portion of the inner tank is disposed with an inner air vent connected to the outer air vent, the bottom portion of the inner tank is disposed with an inner outlet connected to the outer outlet of the outer tank and an inner inlet connected to the chamber of the outer tank, the inner inlet is disposed with a water level control mechanism.

In another preferred embodiment, the water level control mechanism comprises a valve block used to open and close the inner inlet and a floating body disposed in the inner tank, the floating body is connected to the valve block by a connecting rod.

In another preferred embodiment, the inner outlet further comprises a limit element being disposed with a limit through hole sleeved on the connecting rod.

In another preferred embodiment, the lower portion of the inner tank is connected to the outer tank by a lock catch structure.

In another preferred embodiment, the size of the inner outlet is larger than that of the outer outlet.

The present invention has following advantages: with the combination of the inner tank and the outer tank, the water level control mechanism controls the water level of the water tank; the structure is simple and low cost.

BRIEF DESCRIPTION OF THE DRAWINGS

FIG. 1 illustrates a schematic diagram of the present invention.

DETAILED DESCRIPTION OF THE EMBODIMENT

The present invention will be further described with the drawings and the embodiment.

As figured in FIG. 1, a constant water level humidifier comprises an outer tank 1 with an outer outlet 10 disposed at the bottom; the outer outlet 10 is disposed with an oscillating plate 101, the upper portion of the outer tank 1 is disposed with an outer air vent 11 connected to the outer world; the outer tank 1 is further disposed with an inner tank 2; the lower portion of the inner tank 2 is connected to the outer tank 1 by a lock catch structure; the upper portion of the inner tank 2 is disposed with an inner air vent 21 connected to the outer air vent 11, the bottom portion of the inner tank 2 is disposed with an inner outlet 20 connected to the outer outlet 10 of the outer tank 1 and an inner inlet 22 connected to the chamber of the outer tank 1; the size of the inner outlet 20 is larger than that of the outer outlet 10. The inner inlet 22 is disposed with a water level control mechanism 23.

The water level control mechanism 23 comprises a valve block 230 used to open and close the inner inlet 22 and a floating body 231 disposed in the inner tank 2, the floating body 231 is connected to the valve block 230 by a connecting rod 232. The inner outlet 20 further comprises a limit element 201 being disposed with a limit through hole 2010 sleeved on the connecting rod 232.

When no water is in the inner tank 2, the floating body 231 of the water level control mechanism 23 falls down, driving the valve block 230 to open the inner inlet 22; at this time, water is filled to the outer tank 1, water in the outer tank 1 flows to the inner tank 2 through the inner inlet 22 and the water level in the water tank 2 raises, the floating body 231 floats up until it drives the valve block 230 to close the inner inlet 22, thereby the water level in the inner tank 2 keeps constant; when the oscillating plate 101 works, the water level in the inner tank 2 falls down, the floating body 231 drives the valve block 230 to fall down, again the inner tank 2 is connected to the outer tank 1, water in the inner tank 2 raises up to be constant.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A constant water level humidifier, comprising an outer tank with an outer outlet disposed at the bottom, the outer outlet is disposed with an oscillating plate, the upper portion of the outer tank is disposed with an outer air vent connected to the outer world; wherein the outer tank is further disposed with an inner tank, the upper portion of the inner tank is disposed with an inner air vent connected to the outer air vent, the bottom portion of the inner tank is disposed with an inner outlet connected to the outer outlet of the outer tank and an inner inlet connected to the chamber of the outer tank, the inner inlet is disposed with a water level control mechanism.

2. The constant water level humidifier according to claim 1, wherein the water level control mechanism comprises a valve block used to open and close the inner inlet and a floating body disposed in the inner tank, the floating body is connected to the valve block by a connecting rod.

3. The constant water level humidifier according to claim 2, wherein the inner outlet further comprises a limit element being disposed with a limit through hole sleeved on the connecting rod.

4. The constant water level humidifier according to claim 1, wherein the lower portion of the inner tank is connected to the outer tank by a lock catch structure.

5. The constant water level humidifier according to claim 1, wherein the size of the inner outlet is larger than that of the outer outlet.

* * * * *